US011763784B2

(12) United States Patent
Shuck

(10) Patent No.: US 11,763,784 B2
(45) Date of Patent: Sep. 19, 2023

(54) MUSICAL INSTRUMENT SHIELD FOR PLAYING WIND BLOWN INSTRUMENTS

(71) Applicant: Pamela Yee Shuck, Oakland, MI (US)

(72) Inventor: Pamela Yee Shuck, Oakland, MI (US)

( * ) Notice: Subject to any disclaimer, the term of this patent is extended or adjusted under 35 U.S.C. 154(b) by 0 days.

(21) Appl. No.: 17/510,384

(22) Filed: Oct. 26, 2021

(65) Prior Publication Data

US 2022/0277712 A1 Sep. 1, 2022

Related U.S. Application Data

(60) Provisional application No. 63/083,867, filed on Sep. 26, 2020.

(51) Int. Cl.
*G10D 9/00* (2020.01)

(52) U.S. Cl.
CPC ..... *G10D 9/00* (2013.01)

(58) Field of Classification Search
CPC ..... G10D 9/00; G10D 3/00
See application file for complete search history.

(56) References Cited

U.S. PATENT DOCUMENTS 11,328,697 B1 * 5/2022 Stewart ..... G10D 9/00

* cited by examiner

*Primary Examiner* — Kimberly R Lockett

(57) ABSTRACT

The musical instrument shield invention is a clear or translucent enclosure made of flexible plastic material that aids to contain droplets from spreading while still providing full view of the instrument. Access ports for the musicians' hands, fingers, clip rings, and thumb rests are cut in the plastic and reinforced as needed to prevent tearing. The musical instrument shield is attached to the neck of the instrument with ties, string, elastic, laces, Velcro or other suitable material to hold the proximal end of the shield around the instrument. The woodwind shield can incorporate one or more filtered vents that prevent pressure from building up during playing yet still resist any infectious droplets from passing out of the shield. The access ports are closed when not in use and direct any aerosols that may escape through the ports while in use down toward the ground. The clear shield allows teachers and others to see the instrument and musician's fingering while still providing unencumbered playing and clear producing sound. The see through shield can be made of any non-porous material that can effectively block transmission of infectious droplets or air borne viruses. A hybrid shield made of both clear and opaque materials would allow for the instrument to be visualized as well as vented to prevent pressure build-up within the shield.

Other objects and advantages of the invention will become apparent from the following claims and detailed description of the invention taken in conjunction with the accompanying drawings.

13 Claims, 2 Drawing Sheets

MUSICAL INSTRUMENT SHIELD FOR PLAYING WIND BLOWN INSTRUMENTS

CROSS-REFERENCE TO RELATED APPLICATIONS

This application claims priority to U.S. Provisional Patent Application No. 63/083,867 filed Sep. 26, 2020.

BACKGROUND

Field

This relates to a musical instrument shield that is used to slow the rate of disease transmission caused by infectious droplets or aerosols while playing the instruments.

Relevant Prior Art

The following prior art appears relevant:

| | | |
|---|---|---|
| 6,774,296 | August 2004 | Aesch |
| 6,239,338 | May 2001 | Robinson |
| 5,875,890 | March 1999 | DiBernardini |
| 8,637,756 | January 2014 | Brawley |
| 9,552,799 | October 2015 | Brawley |

Covid-19 is the deadliest pandemic in United States' history. Because of how easily the disease is spread via droplets from infected people, this pathway needs to be blocked to minimize transmission. The present embodiment relates to musical instrument shields for the protection of infection spreading through musicians' droplets and aerosols as musicians blow through their brass and woodwind instruments. Infection protection shields have mostly been used as face shields in the medical community to protect the healthcare worker from direct sneezes, coughs, or other patient produced sprays. In the era of the Covid-19 pandemic, plastic face shields have also been used by the general public to protect both the wearer and others in the near vicinity. Most live music venues were shut down during the Covid-19 pandemic not only because it is difficult for the audience to physically distance, but also because musicians were not able to easily control potentially infected droplets that are exhaled through normal breathing and through their instruments.

With the introduction of Covid-19 and anticipation of other future novel coronaviruses for which there are not vaccines, the CDC recommends the best way to prevent infection spread when out in public is the wearing of face coverings such as face masks, handwashing, and physically distancing at least six feet apart from others. Musicians who play instruments such as woodwinds or brass can play through improvised face masks but the air coming from the instrument is not captured by the mask. Viruses, including the Covid-19, are transmitted from human-to-human by droplets, aerosols, and fomites.

Musicians in school bands, community bands, and professional bands run the risk of spreading viruses when potentially infected members play instruments such as woodwinds and brass without protecting all key holes and other openings where air or droplets escape the instrument. It is also difficult to maintain six feet of distance (or greater when pertaining to the more transmissible viruses such as the Delta virus) between members of large bands on a stage due to the large size of the stage needed.

The physical or social distancing guideline of greater than six feet away from others allows any larger droplets time to drop to the ground or be diluted before reaching others. Physical distancing does not prevent spread 100% of the time as factors such as wind, fans, and HVAC could potentially keep micro droplets airborne for longer distances and times.

There have been many musical instrument cases for fully assembled instruments such as U.S. Pat. No. 8,637,756 (2014), 9,552,799 (2015) both to Brawley but these are meant primarily as damage protection cases and the user must still remove the cover in order to play the instrument. U.S. Pat. No. 5,875,890 (1999) to DiBernardini and U.S. Pat. No. 6,239,338 (2001) to Robinson offer soundproofing while playing instruments so the covers are heavy and opaque. U.S. Pat. No. 6,774,296 (2004) to Aesch is a clarinet weather shield cover but it is open on both ends so is not conducive to preventing droplets from leaving the shield. Because the world has not experienced a disease that is so easily spread even by non-symptomatic people, a protective instrument shield has not had any utility until recently.

Musical instrument covers that enclose fully assembled instruments are made of porous, opaque fabric that do not adequately filter the aerosols nor do they allow the unencumbered visualization of the musicians' fingering.

DRAWINGS—FIGURES

Figure 1:
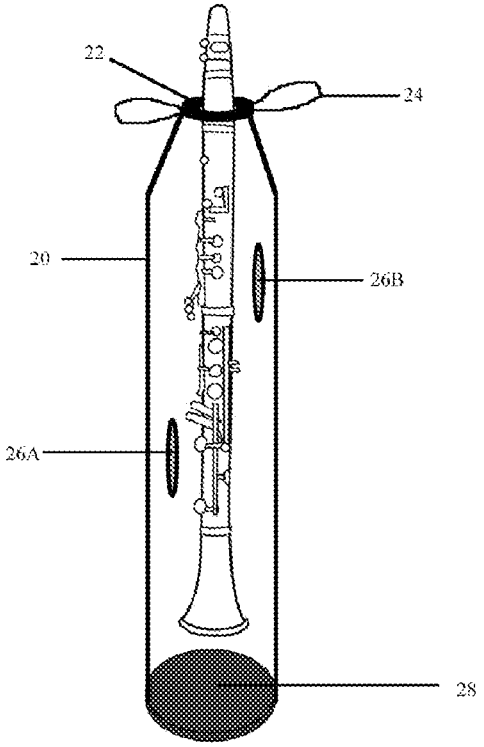
FIG. 1 shows a shield body (20) enclosing a clarinet with a top cuff (22), a drawstring closure (24), two hand ports (26A, 26B), and a filtered vent (28).

| Drawings—Reference Numerals | |
|---|---|
| 20 | Shield body |
| 22 | Cuff |
| 24 | Drawstring closure |
| 26A, 26B | Hand ports |
| 28 | Filtered Vent |
| 30A, 308B | Hand port flaps |
| 32 | Double sided tape |
| 34 | Open end cuff |
| 36 | Instrument support slot |
| 38 | Sealed shield bottom |

DETAILED DESCRIPTION—FIGS. 1, 2 AND 3—FIRST EMBODIMENT

One embodiment of the shield is illustrated in FIG. 1 (front view). The shield body (20) is made of a clear or translucent plastic film that prevents fluid droplets, aerosols, or air to permeate it from either direction. The body (20) is preferably made of extruded polyethylene tube plastic such as 2 mil thickness polyethylene tubing available from ULine Corporation. The diameter of the tube is large enough to easily insert the instrument with enough excess so that the plastic does not interfere with the playing of the instrument, generally at least 5" for small instruments such as flutes and clarinets up to 10" for saxophones. The plastic used to fabricate the shield should not crinkle loudly when touched so as to minimize noise interfering with musical notes.

A filtered vent (28) is shown at the bottom of the shield but its location is not limited to the location shown in FIG. 1. The vent is made of a material such as fabric, foam, filter or any other material that functions to allow air to pass through it but resists the passage of droplets. The vent can be attached to the shield with stitches, adhesive, heat seal, or any other method that forms a tight seal between the shield body (20) and vent (28).

A cuff (22) cinches down around the top of the instrument such that the mouthpiece still protrudes out of the shield. A double drawstring (24) is shown such that the user pulls both loops to tighten the cuff around the instrument but this can also be a single loop drawstring as well. The cinched cuff (22) provides both a method to attach the shield to the instrument as well as to take up the slack of the shield opening to form a seal around the instrument.

Two hand ports (26A, 26B) are shown corresponding to where one needs to place ones hands on the instrument. The hand ports are sized so that the musician's fingers or hands can easily be inserted into the shield with ease, generally between 4-7 inches long.

Figure 2:
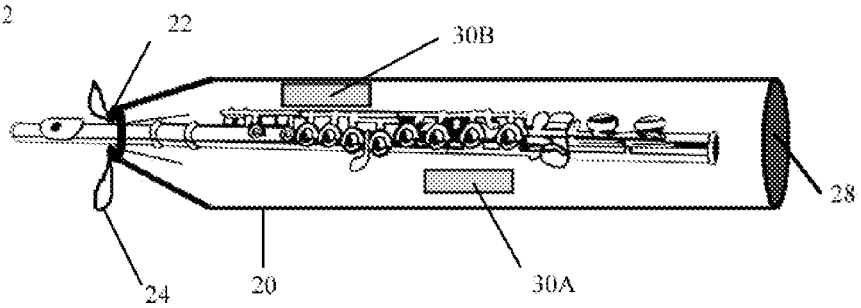
FIG. 2 shows a shield body (20) enclosing a flute with a cuff (22) tightened with a drawstring closure (24), two hand port flaps (30A, 30B), and a filtered vent (28).

In FIG. 2, flaps (30A, 30B) attach to the shield body (20) over the hand ports (26A, 26B in FIG. 1). The flaps (30A, 30B) can be made from fabric, thin foam, plastic, or any other flat material that provide coverage over the hand port openings. The flaps (30A, 30B) provide a visual cue to the musician as to where to insert ones hands into the shield body (20). Additionally, the flaps (30A, 30B) help contain the air within the shield as well as help direct any escaping air away from others in close proximity when the hand ports (26A, 26B) are in use. For example, when one plays the clarinet, the flaps open back toward the player instead of toward other surrounding players. When one plays a flute, the flaps direct the air stream downward because one's hands enter the hand ports from under the instrument. This in effect achieves the same goal that physical distancing does but without relying solely on gravity to achieve.

Figure 3:
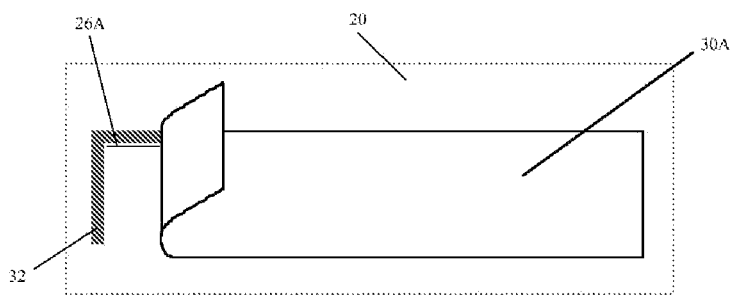
FIG. 3 shows the assembly of a hand port flap (30A) covering a hand port (26A) on the shield body (20) with double sided tape (32).

FIG. 3 shows the assembly of a flap (30A) over the hand port (26A). The flap is cut slightly longer than the length of the hand port (26A) and is affixed to the shield body (20) on three of its sides with ¼" wide double sided tape such as 3M's 444 tape (32). Besides double sided tape, other methods of fastening include but are not limited to stitching, adhesive, and heat bond. This in effect forms a pocket with a passageway at its base through which to place ones hands. The pocket flaps guide the hands through the hand ports such that the user's wrists do not enter the shield body perpendicularly where the hand port's raw plastic edges are more prone to cause skin irritation.

Figure 4:
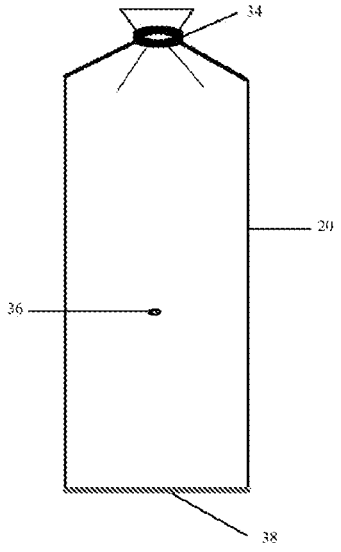
FIG. 4 shows the back of a similar instrument shield body (20) with variations of an open end cuff (34), an additional instrument support slot (36), and a sealed shield bottom (38).

Operation—FIGS. 1, 2, 4

The manner of using the see through musical instrument shield is one first inserts the wind blown instrument through the top shield opening such as shown in FIGS. 1 and 2 for a clarinet and flute, respectively. Next, one tightens the cuff (22) around the instrument next to but not including the mouthpiece. If the instrument such as a saxophone has a ring clip, this clip is pushed out of the shield through the instrument support slot (36) to allow one to hook the instrument to a neck strap worn by the musician. One then inserts one's hands under the flaps (30A, 30B) and through the hand ports (26A, 26B) to gain full access to the instrument and commences to play the instrument.

To remove the shield, one first removes one's hands from both hand ports, then holds the instrument enclosed shield, loosens the cuff, and removes the instrument from the top of the shield. One then can clean and dry the inside of the shield by either hanging it up to dry or wiping the inside of the shield with a dry cloth, similarly to how one dries the inside of one's instrument. Once dry, the shield can be folded up and stored inside the instrument case.

FIG. 4—Additional Embodiments

Additional embodiments are shown in FIG. 4. A shield with an open end cuff (22) can be cinched around the instrument using a belt, Velcro, elastic, ties, or similar binding methods. For instruments such as saxophones that are clipped to a neck strap worn by the musician, an instrument support slot (36) allows the ring to pass through the back of the shield body (20). A sealed shield bottom (36) can replace the filtered vent (28 in FIG. 1) for instruments that do not move large amounts of air.

Advantages

From the description above, a number of advantages of some embodiments of my shield for wind blown instruments become evident:

a) The see through plastic allows viewing of the full instrument and musician's fingering by teachers or surrounding people.
b) Impermeable plastic provides maximum protection to all people in the vicinity of the musician against exposure to infectious droplets that arise via the playing of musical instruments.
c) The materials to fabricate the embodiment are low-cost and easily obtainable
d) Polyethylene plastic tubing is lower cost, less bulky, and lighter than fabric used in previous artwork
e) The plastic shield body allows for cleaning after every use
f) The use of thin gauge plastic such as 2-6 mil polyethylene tubing allows sound waves to pass through it without perceptibly altering the tonal quality of instruments
g) Flaps that cover the hand port openings help direct escaping air away from other people around the musician
h) Flaps that cover the hand port openings collapse down to cover the hand ports when the hand ports are not in use.
i) Placement of a filtered vent allows air pressure to be relieved within the embodiment Conclusion, Ramifications and Scope The reader will see that the musical instrument shield for wind blown instruments of the various embodiments can be used to allow traditionally high risk activities that involve deep breathing, aerosol generating instrument playing to a more confined space within the closed off instrument shield. The shield quickly, easily, inexpensively, and effectively protect against the spread of virus laden droplets to others. Various woodwind and brass instruments can be quarantined within the described embodiments yet still allow for unencumbered playing, for full instrument viewing, and for clear musician's fingering. A hybrid of impermeable plastic, protected hand ports, and semi-permeable filtered vents optimize the protective properties of the embodiments while still allowing safe playing. Furthermore, the plastic see through shield has the additional advantages in that:

It is fabricated from off the shelf materials that are inexpensive.
It is customizable for children, adults, small instruments, and large instruments
It is durable as the plastic is readily available in 2-6 mil thicknesses Polyethylene tubing is available off the shelf in multiple widths of up to 60"

Plastics are easily worked with as they can be sewn, taped, glued, or heat sealed Although the description above contains many specificities, these should not be construed as limiting the scope of the embodiments but as merely providing descriptions of some of several different embodiments. For example, the cuff can be formed using a multitude of materials such as wire, straps, reusable zip ties, belts, elastic, string, Velcro, etc.; the hand port flaps can be made deeper so that they provide more protection over the hand ports; the filtered vent can be made from various fabric, commercially available filters, etc.; a plurality of filtered vents can be located at multiple locations on the shield or not at all.

Thus the scope of the embodiments should be determined by the appended claims and their legal equivalents, rather than by the examples given.

Current US Class: 84/382

The invention claimed is:

1. A shield for windblown musical instruments comprising:

a body; the body having a length to enclose a fully assembled windblown musical instrument with exception of an instrument's mouthpiece; the body having an opening through which an instrument passes when the instrument shield is attached to an instrument; the opening having means for closing of the shield around a windblown instrument to seal the shield around the instrument and to secure the shield to the instrument; the body having two hand ports therein through which hands of a musician are inserted to play an instrument on which the shield is mounted; the hand ports corresponding to locations where a musician places one's hands to play an instrument; and the body having a filtered vent for releasing pressure build-up within the shield.

2. The shield of claim 1 wherein said shield's body is made of a see through material to allow direct visualization of the instrument and musician's fingering.

3. The see through material of claim 2 wherein said material is waterproof to keep potentially infectious droplets within said shield's body.

4. The see through material of claim 2 is made of a thin material as a means to allow sound waves to penetrate it without audibly altering said sound waves' tonal quality.

5. The shield of claim 1 wherein said cuff provides a means for opening and closing an opening through which an instrument is inserted.

6. The cuff of claim 5 wherein said cuff cinches down to seal said shield around the instrument until said shield attaches to the instrument.

7. The shield of claim 1 wherein said hand ports are comprised of slits covered with attached flaps as a means of inserting one's hands under said flaps and through said hand port slits to access one's instrument.

8. The flaps of claim 7 wherein said flaps cover said hand port slits to provide a barrier against fluid droplets from easily exiting the shield through said hand ports.

9. The flaps of claim 7 wherein said flaps direct aerosol escaping from said hand ports downward to the ground and back toward the musician player.

10. The flaps of claim 7 wherein said flaps attach to one edge of each hand port slits to guide musician's hands into the shield in a parallel direction to the shield body to minimize exposure of said hand port slits' raw edges from rubbing against musician's skin.

11. The shield of claim 1 wherein said filtered vent is made of a semi-permeable material to release pressure build-up within the shield while resisting droplet penetration.

12. The shield of claim 1 further comprising a slot on the back of said shield for hooking a neck strap to an instrument support ring.

13. A method of playing an enclosed windblown musical instrument for protecting against the spread of potentially unsafe virus laden droplets comprising:

(a) providing a see through waterproof shield comprising a tubular shield body, hand ports, a filtered vent, and a resealable cuff, (b) providing an instrument and inserting the instrument through said shield's cuff, leaving only said instrument's mouthpiece protruding, (c) cinching said cuff around an instrument so that only said instrument's mouthpiece is protruding from the shield, (d) inserting one's hands through said hand ports to position one's hands around said instrument, (e) commencing to play said instrument.

* * * * *